United States Patent [19]

Tölle

[11] Patent Number: 5,039,144

[45] Date of Patent: Aug. 13, 1991

[54] DOOR ARRESTER FOR MOTOR VEHICLE DOORS

[75] Inventor: Karl-Heinz Tölle, Wuppertal, Fed. Rep. of Germany

[73] Assignee: ED. Scharwächter GmbH & Co. KG, Remscheid, Fed. Rep. of Germany

[21] Appl. No.: 529,146

[22] Filed: May 25, 1990

[30] Foreign Application Priority Data

May 26, 1989 [DE] Fed. Rep. of Germany ..... 3917079

[51] Int. Cl.[5] ..... E05C 19/12

[52] U.S. Cl. ..... 292/250; 292/DIG. 53; 292/341.12; 292/278

[58] Field of Search ..... 292/341.12, 341.11, 292/341.13, DIG. 73, DIG. 56, DIG. 58, 77, 79, 73, 15, DIG. 23, 341.17, 304, 193, 108, 278, 246, 250

[56] References Cited

U.S. PATENT DOCUMENTS

| | | | |
|---|---|---|---|
| 1,177,407 | 3/1916 | Gilson | 292/DIG. 58 |
| 1,180,814 | 4/1916 | Ziganek | 292/79 |
| 2,132,733 | 5/1937 | Hammerbeck | 292/79 |
| 2,135,905 | 11/1938 | Loftin et al. | 292/341.11 |
| 3,259,412 | 7/1966 | Wheeler | 292/DIG. 31 |
| 4,230,352 | 10/1980 | Sealey et al. | 292/341.17 |

*Primary Examiner*—Eric K. Nicholson

*Assistant Examiner*—Darnell M. Boucher

*Attorney, Agent, or Firm*—Toren, McGeady & Associates

[57] ABSTRACT

In a door arrester for motor vehicle doors, including a retainer housing fastened at a door arrangement part, door or door post, and a door holding rod fastened at the other door arrangement part pivotable around an axis parallel to the door hinge axis, where a snap-in member arranged in the retainer housing is configured as a rocking lever and is on one side loaded by a pressure spring designed as a spiral spring and on another side cooperates by way of a snap-in roller with the door holding rod, wherein the rocking lever carrying the snap-in roller is supported in the retainer housing so as to be pivotable around an axis parallel to the door hinge axis and cooperates with the door holding rod through a backup snap-in roller supported at the door holding rod around an axis also parallel to the door hinge axis, in order to achieve uniformly high and smoothly applied braking and holding forces in both directions of motion of the door, a constrained guidance curved in an arc-shaped manner is configured at the retainer housing in an extension of the guidance track arranged at the outer surface of the retainer housing for the backup snap-in roller arranged at the free end of the door holding rod located opposite to the snap-in roller.

14 Claims, 2 Drawing Sheets

DOOR ARRESTER FOR MOTOR VEHICLE DOORS

BACKGROUND OF THE INVENTION

The invention deals with a door arrester for motor vehicle doors, having a retainer housing fastened at one door arrangement part, door or doorpost, and a door holding rod fastened to another door arrangement part so as to be pivotable around an axis parallel to the door hinge axis. A snap-in member designed as a rocking lever is arranged in the retainer housing and is on one side stressed by a pressure spring constructed as a spiral spring and on another side coacts with the door holding rod through a snap-in roller. The rocking lever carrying the snap-in roller is supported in the retainer housing so as to be pivotable around an axis parallel to the door hinge axis and coacts with the door holding rod by means of a backup snap-in roller also supported at the door holding rod around an axis parallel to the door hinge axis.

Door arresters of this construction intended especially for motor vehicle doors are as such known, wherein the door holding rod is articulated around an axis parallel to the door hinge axis at one door arrangement part and is provided at its free end with a backup snap-in roller arranged to be axially parallel to its articulation axis. Herein, a retainer housing, composed of two folded and connected with each other flat material blanks and fastened to the other door arrangement part, is assigned to the door holding rod. One portion of the retainer housing is a pure guidance part and its other portion is a support housing for a snap-in member designed as a rocking lever arranged therein. The backup snap-in roller arranged at the free end of the door holding rod is hereby guided in a straight line slotted guide arranged in the retainer housing and is abutted against a support face extending parallel to the slotted guide in the region of the length of the rocker lever arm carrying the snap-in roller. In this arrangement, the backup snap-in roller diverts the rocking lever counter to the spring force acting on same when it contacts its snap-in roller which engages in the unloaded state tangentially into the slotted guide, whereby a braking effect with subsequent snap-in action arises. The rotational axes of the snap-in roller and the backup snap-in roller as well as the tilting axis of the rocking lever are herein oriented to be parallel to the door hinge axis. Such a design of a door arrester is only suitable for the heavy doors of large commercial vehicles having large angles of opening, wherein it provides the advantage that holding forces of differing magnitude can be achieved in the door arrester in the opening and closing direction of the door.

SUMMARY OF THE INVENTION

Contrary to the above, it is an object of the present invention to provide a door arrester for doors of passengers in motor vehicles, which enables as noiseless an operation as can be achieved in both directions of motion of the door as well as assuring a uniformly high and softly building braking and retaining force, with the lowest possible fabrication and installation costs.

Pursuant to this object, and others which will become apparent hereafter, one aspect of the present invention resides in arranging a constrained guidance curved in an arc-shaped manner at the retainer housing by way of an extension of a guidance track arranged at the external surface of the retainer housing for the snap-in roller located oppositely to the backup snap-in roller arranged at the free end of the door holding rod.

In order to obtain a smoothly applied braking or retaining force of the arrester, the constrained guidance assigned to the backup snap-in roller is curved in an arc-shaped manner towards the snap-in roller of the rocking lever and is curved in an arc-shaped manner away from the snap-in roller of the rocking lever, so that it encloses respectively one funnel-shaped angle with the snap-in roller of the rocking lever aimed in both directions of motion of the backup snap-in roller in the region of the snapped-in open position of the door. The constrained guidance curved in an arc-shaped manner is symmetrically designed from a highest point at both retainer housing-guidance part/profile legs, in order to assure braking or retaining forces of different magnitude in both directions of the doors. Furthermore, the constrained guidance is arranged in such a way that its highest point is located upstream of the apex point of the snap-in roller if it is unloaded and if the snap-in roller is under load at a specific entry angle of the backup snap-in roller, for instance at an entry angle of 42° lying opposite the apex point of the snap-in roller.

A particularly favorable embodiment of the constrained guidance results from the constrained guidance for the backup snap-in roller being arranged at a portion of the retainer housing overlapping the snap-in roller at least partially and in a capture hook-like manner.

Furthermore, the invention provides that a radial force action line is arranged to extend between the snap-in roller and the backup snap-in roller spaced from and beneath the rocker axis of the rocking lever, wherein the spacing between the force action line and the rocker axis defines the holding force to be supplied by the door arrester.

In a preferred embodiment of the invention, it is provided for the shaping and arrangement of the door holding rod, that the door holding rod is spring-loaded around its articulation axis at the door arrangement part and under the effect of the spring loading is held in contact with a certain contact pressure against a guidance track configured at the retainer housing throughout the entire opening travel of the door. This contact pressure prevents the backup snap-in roller from leaving the guidance track if also subjected to the shock effects of the driving operation of the vehicle.

The door holding rod itself is appropriately formed by a tie rod of round material and is stressed by means of a spring clip arranged to be axially parallel to its articulation axis so as to abut against the bearing block of the door holding rod. The backup snap-in roller herein advantageously extends at least approximately across the entire width of the retainer housing.

In a further embodiment of the invention it, is provided in shaping the retainer housing, that the retainer housing is subdivided in a longitudinal direction and is altogether composed of two molded portions from flat material each forming one half and connected with each other by means of lugs and rivet bolts as well as the rocker axis of the rocker lever. In this way the guidance track for the backup snap-in roller configured at the top side of the retainer housing is designed as an essentially a smooth surface which, is continuous except of a longitudinally oriented slotted aperture remaining possibly thereon, with this surface providing a wide contact or support base for the backup snap-in roller.

The constrained guidance of the backup snap-in roller is advantageously formed by the end faces of profile legs of a front portion of the retainer housing designed in a capture hook-like manner. The profile legs are oriented to be perpendicular to the direction of motion of the backup snap-in roller.

In another preferred embodiment of the invention, the spiral spring stressing the rocker lever is abutted against the bottom side of the guidance track assigned to the backup snap-in roller. Furthermore, the rocker lever carrying the snap-in roller is provided at its spring-loaded end with a stop resting at the stop face or at the bottom portion of the retainer housing and determining the position of the snap-in roller in the unloaded state.

Finally it can be additionally provided for assuring permanently noise-free operation of the door arrester, that the snap-in roller supported at the rocker lever be equipped with a maintenance-free bearing system formed by bearing bushes made from maintenance-free bearing material.

In order to assure a permanently noise-free operation of the door arresters, it can also be provided that the snap-in roller supported at rocker lever be equipped with covers containing a lubricant supply clipped-on on both sides of the snap-in roller.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DETAILED DESCRIPTION OF THE PREFERRED EMBODIMENTS

Figure 1:
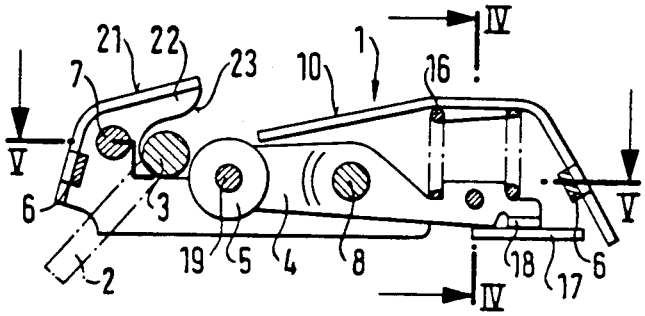
FIG. 1 is a longitudinal section through a door arrester pursuant to the present invention.
Figure 2:
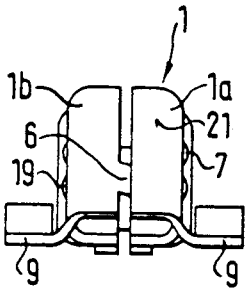
FIG. 2 is a front view of the door arrester in FIG. 1.
Figure 3:
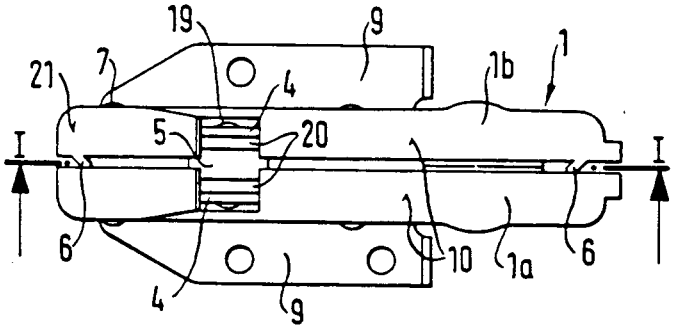
FIG. 3 is a plan view of the door arrester in FIG. 2.
Figure 4:
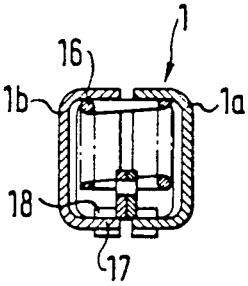
FIG. 4 is a section through the door arrester in FIG. 1 along the line IV—IV in FIG. 1.
Figure 5:
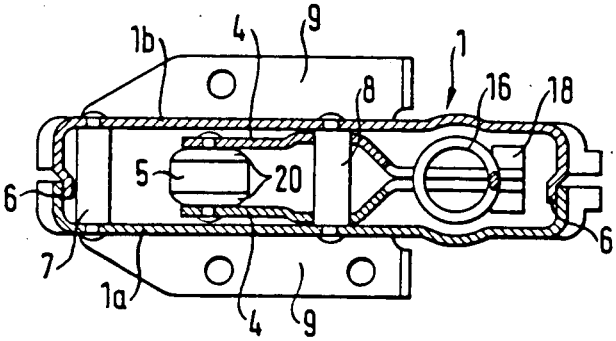
FIG. 5 is a section through the door arrester in FIG. 1 along the line V—V in FIG. 1.
Figure 6:
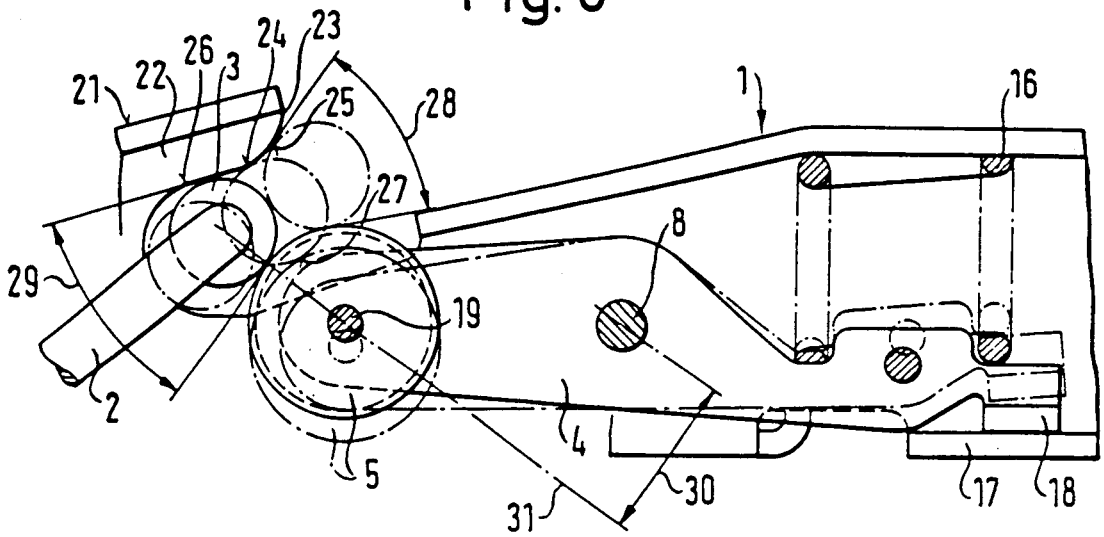
FIG. 6 is a diagrammatic operational diagram of the door arrester in FIGS. 1 to 5.
Figure 7:
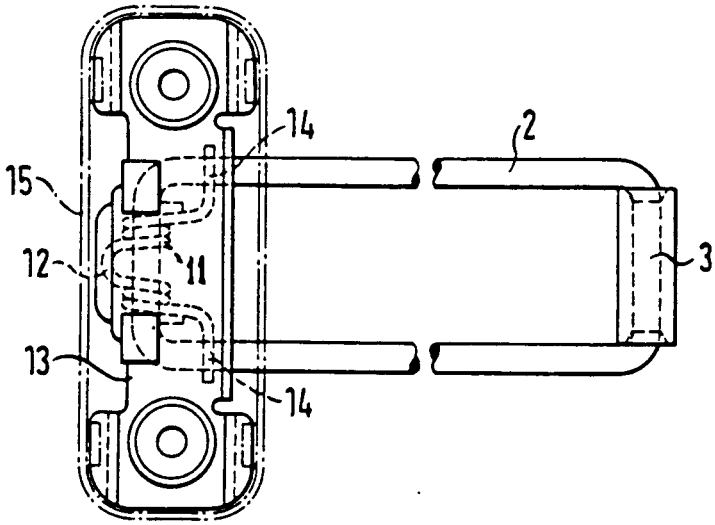
FIG. 7 is a side view of the door holding rod for a door arrester in FIGS. 1 to 6.

The door arrester shown in the drawings comprises a retainer housing 1 and a door holding rod 2. The door holding rod 2 and a backup snap-in roller 3 supported rotatably thereon as well as a rocking lever 4 constituting a snap-in member and a snap-in roller supported thereon are rotatable or pivotable around axes parallel to each other and to an articulation or hinge axis of the door not shown in the drawing.

The retainer housing in the embodiment example shown is formed of two shaped parts 1*a* and 1*b* made respectively from a flat material blank, wherein the two shaped parts 1*a* and 1*b* are connected with each other at the end side of the retainer housing by means of lugs 6 and additionally by a rivet 7 as well as the rocker axis 8 of the rocker lever 4. The retainer housing 1 has a generally U-shaped cross-sectional profile and is provided with attachment flanges 9 on both sides, by means of which it can be fastened to the assigned door arrangement part. The retainer housing 1 is provided at its top side with a smooth surface and an essentially continuous guidance face 10, against which the backup snap-in roller 3 arranged at the door holding rod 2 rests under the action of a spring 11 acting upon the door holding rod.

The spring 11 is configured as a spiral spring and is abutted by its one leg 12 at a bearing block 13 supporting the door holding rod 2 at a door arrangement part, while it engages its other legs 14 at the door holding rod 2. The door holding rod 2 itself is formed from a round material section bent into a rectangular shape in plan view.

In the embodiment shown, the bearing block 13 is overlapped by a clipped-on covering hood 15. The rocker lever 4 supported pivotably around the rocker axis 8 in the retainer housing 1 carries a snap-in roller 5 at its one end and is stressed at its other end by means of a pressure spring 16 abutted against the bottom portion of the guidance track 10. Furthermore, the rocker lever 4 is provided at its end stressed by the pressure spring 16 with a stop 18 resting at a bottom portion 17 of the retainer housing 1 and defining the position of the snap-in roller 5 in the unloaded state.

The snap-in roller 5 is supported to be rotatable around an axis 19 at the rocking lever 4 and is provided on both sides with clipped-on shell-shaped covers 20, which contain a lubricant supply. The guidance track 10 is arranged to be inclined against the front end of the retainer housing 1 toward its stop base in the embodiment shown and it furthermore extends tangentially to the circumference of the unloaded snap-in roller 5. The front portion 21 of the retainer housing 1 is designed in a capture hook-like manner and overlaps the snap-in roller 5 up to a certain slight amount.

A constrained guidance 23 for the backup snap-in roller 3 configured to curve in an arc-shaped manner is provided at the front faces of the vertically downward oriented legs 22 of the front portions 21 of the retainer housing 1 configured in a capture hook-like manner. The constrained guidance 23 comprises curved regions 25 and 26 on both sides arranged symmetrically with respect to a highest point 24 and in the embodiment shown is altogether arranged in such a way that, with the snap-in roller 5 unloaded, its highest point 24 is located upstream of its apex point 27 and with the snap-in roller 5 loaded as well as with an entry angle of 42° of the backup snap-in roller 3 it lies opposite to the apex point 27 of the snap-in roller 5. Because of the symmetrical design of the two curved regions 25 and 26 of the constrained guidance, there result together with the circumferential surface of the snap-in roller 5, two funnel-shaped angles 28 and 29 of equal size, of which one is assigned to the opening motion and the other to the closing motion of the door, so that resulting from these equally large funnel angles 28 and 29, braking or holding forces of equal magnitude are applied in both directions of motion of the door. The magnitude of the braking or holding forces to be supplied by the door arrester is defined by the spacing 30 at which a radial force action line 31 extends with respect and beneath the rocker axis 8 of the rocking lever 4.

While the invention has been illustrated and described as embodied in a door arrester for motor vehicle doors, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. A door arrester for a motor vehicle door having door arrangement parts, comprising: a retainer housing fastened at one door arrangement part; a door holding rod fastened to another door arrangement part so as to be pivotable around an axis parallel to a door hinge axis; snap-in means arranged in the retainer housing, said snap-in means including a rocking lever loaded on one side by a spiral pressure spring and coacting on another side with the door holding rod via a snap-in roller, the rocking lever being supported in the retainer housing so as to be pivotable around a rocker bearing axis parallel to the door hinge axis, and coacting with the door holding rod around an axis parallel to the door hinge axis by way of a backup snap-in roller supported at a free end of the door holding rod; and a constrained guide curved in an arc-shaped manner and arranged at the retainer housing 1 so as to form a continuation of a guidance track 10 arranged at an outer surface of the retainer housing 1 for the backup snap-in roller 3 arranged at the free end of the door holding rod 2 and located opposite to the snap-in roller 5.

2. A door arrester according to claim 1, wherein the constrained guide is curved in an arc-shaped manner towards the snap-in roller 5 of the rocking lever 4 and also away from the snap-in roller 5 of the rocking lever 4 so that the guide encloses in a region of a snapped-in opened position of a door respectively, one funnel-shaped angle 28, 29 with the snap-in roller 5 of the rocking lever 4 in both directions of motion of the backup snap-in roller 3.

3. A door arrester according to claim 1, wherein a radial force action line 31 is arranged so as to extend between the snap-in roller 5 and the backup snap-in roller 3 spaced from and beneath the rocker bearing axis 8 of the rocking lever 4.

4. A door arrester according to claim 1, wherein the constrained guide for the backup snap-in roller 3 is arranged at a part 21 of the retainer housing 1 at least partially overlapping the snap-in roller 5 in a capture hook-like manner.

5. A door arrester according to claim 1, wherein the door holding rod 2 is supported at said another door arrangement part so as to be spring-loaded around its articulation axis as well as under a spring-loading effect across an entire opening travel of the vehicle door at the guide track 10.

6. A door arrester according to claim 1, wherein the door holding rod 2 has a round material section and is stressed by a spiral spring 11 arranged so as to be axially parallel to the articulation axis of said door holding rod 2.

7. A door arrester according to claim 1, wherein the backup snap-in roller 3 extends at least approximately across the entire width of the retainer housing 1.

8. A door arrester according to claim 1, wherein the retainer housing 1 is subdivided in a longitudinal direction and is composed of two parts 1*a*, 1*b* of flat material each constituting one half of the retainer housing, the two parts being connected with each other by lugs 6 and rivet bolts 7 as well as the rocker bearing axis 8 of the rocking lever 4.

9. A door arrester according to claim 1, wherein the guidance track 10 is an essentially continuous surface.

10. A door arrester according to claim 1, wherein the constrained guide for the backup snap-in roller 3 is formed by front faces of profile legs 22 arranged perpendicular to a direction of motion of said backup snap-in roller 3, the profile legs 22 being part of a front portion 24 of the retainer housing 1 formed in a capture hook-like manner.

11. A door arrester according to claim 1, wherein the pressure spring 16 is supported against a bottom side of the guidance track 10 assigned to the backup snap-in roller 3.

12. A door arrester according to claim 1, wherein the rocking lever 4 carrying the snap-in roller 5 is provided at its spring-loaded side with a stop 18 which rests at a stop face or a base portion 17 of the retainer housing 1 so as to define the position of the snap-in roller 5 in an unloaded state.

13. A door arrester according to claim 1, wherein the snap-in roller 5 supported at the rocking lever 4 is provided with a maintenance-free bearing system formed by bushings from a maintenance-free bearing material.

14. A door arrester according to claim 1, wherein the snap-in roller 5 supported at the rocking lever 4 is equipped on both sides with clipped-on covers 20 containing a lubricant.

* * * * *